United States Patent [19]

Negro

[11] Patent Number: 4,721,136

[45] Date of Patent: Jan. 26, 1988

[54] BINDING COMB SHAPING DEVICE

[75] Inventor: Guido Negro, Neuffen, Fed. Rep. of Germany

[73] Assignee: bielomatik Leuze GmbH & Co., Fed. Rep. of Germany

[21] Appl. No.: 880,172

[22] Filed: Jun. 30, 1986

[30] Foreign Application Priority Data

Jul. 2, 1985 [DE] Fed. Rep. of Germany ..... 3523557

[51] Int. Cl.[4] ..... B21F 45/16

[52] U.S. Cl. ..... 140/71 R

[58] Field of Search ..... 140/1, 71 R, 102, 105

[56] References Cited

U.S. PATENT DOCUMENTS 2,849,904 9/1958 Hill ..... 72/108

3,566,927 3/1971 Adams ..... 140/71 R

FOREIGN PATENT DOCUMENTS 3405919 9/1984 Fed. Rep. of Germany .

*Primary Examiner*—Lowell A. Larson

*Attorney, Agent, or Firm*—Steel, Gould & Fried

[57] ABSTRACT

A binding comb shaping device for producing profile-bent binding combs for comb binding of sheet layers has rotary bending tools with bending sliding edges and/or in the form of rolling members, which, between advance cycles of the binding comb blank, move past shaping edges of shaping anvils in arcuate paths and thereby in a substantially vibration-free manner and at high working speeds give the binding comb blank its profile shape.

34 Claims, 8 Drawing Figures

53
79
68
51
24
80
21
45
30
39
37
4
34
41
44
46
41
42
48
54
55
47
42
40
52
40
36
29
55
61
61
63
66
25
33
67
10
28
27
9
23
12
8
13
22
78
26
5

BINDING COMB SHAPING DEVICE

BACKGROND OF THE INVENTION

The present invention relates to a binding comb shaping device for producing in longitudinal view profile-bent binding combs from binding comb blanks, which have transversely directed comb webs located between the longitudinal boundaries of the combs and provided for comb binding of sheet layers. At least one bending device is provided on a bracket having a shaping anvil defining a bearing plane and a median longitudinal plane of the binding comb blank approximately at right angles thereto having at least one bending shaping edge and a bending tool with a bending face movably mounted with respect to the same, whilst interposing the binding comb blank with a driven tool carrier in a working movement with respect to a mounting support.

In a known binding comb shaping device of this type (German Pat. No. 34 05 919 A1 dated Sept. 6, 1984), the bending tool is provided on a tool carrier linearly reciprocating over a working stroke. This leads to a need to overcome very high inertial forces. The forces make it difficult to achieve high working speeds, and even at relatively low working speeds requires an extremely bulky and therefore space-consuming construction of the shaping device, leads to relatively large tolerances of the bent binding comb and gives rise to a large amount of noise.

SUMMARY OF THE INVENTION

The problem of the present invention is to provide a binding comb shaping device of the aforementioned type, which makes it possible to reduce the vibrations which occur, in the case of a compact and simple construction.

In the case of a binding comb shaping device of the aforementioned type, this problem in solved in that at least one bending tool is arranged in rotary manner in its working movement. As a result in its working movement the bending tool describes a curved cam path, which can be obtained through a relatively simple mounting support or bearing and which also makes it possible to greatly reduce the masses to be moved.

It is also conceivable to drive the bending tool in reciprocating manner in its working movement between two rotational end positions. The bending tool engages or cooperates in timing manner with the shaping anvil synchronously with an intermittent advance of the binding comb blank, providing a binding tool profiled in complementary manner to the associated shaping edge of the anvil. However, the shaping device can be further simplified in that the bending tool is arranged so as to further rotate on the tool carrier between the working movements in the same rotation direction to the initial position of the next bending working movement. Thus, the tool carrier can be constructed in simple manner as a tool rotor, which only rotates in one direction, so that it is possible to still further reduce the masses to be accelerated. Particularly in this case, the bending face can be made linear in a simple manner, thereby ensuring a precisely defined engagement on the binding comb blank during the bending process.

In the case of a very simple embodiment of the invention, the rotation axis of the bending tool is approximately parallel to the bearing plane for the binding comb blank and in particular approximately parallel to the median longitudinal plane thereof, so that over the entire arc angle by which the bending face is in engagement with the binding comb blank during the bending working movement, it uniformly engages thereon. It is also conceivable to place the rotation axis of the bending tool laterally within the associated shaping edge of the shaping anvil, in such a way that the bending tool in the manner of an inner rotor passes round the shaping edge with an arc curvature equidirectional to said curvature. It has also been found that, despite an oppositely directed curvature of the shaping edge and the path of the bending tool, a very accurate, e.g. quadrant-shaped profile bending of the binding comb blank can be obtained, so that to simplify the construction of the shaping device, the rotation axis is preferably positioned laterally outside the associated lateral shaping edge of the shaping anvil.

It is also conceivable instead of moving the bending tool along a pitch circle or circular operating arc path to move it in an arc path diverging therefrom, i.e. with changing radial spacings with respect to an imaginary, apparatus-fixed rotation axis, which can e.g. be brought about by a cam control for approximating this movement path to reflect the profile configuration of the shaping edge. However, a further simplification of the shaping device construction is obtained if the rotation axis of the bending tool is apparatus-fixed in its working position, i.e. is position-invariable with respect to the bracket, so that during operation the bending tool follows a circular path. It has been found that even in this case the binding comb blank can be bent in one operation over an arc angle of at least 90° C., particularly if the rotation axis is positioned approximately in the centre of the extension of the associated shaping edge of the shaping anvil at right angles to the bearing plane for the binding comb blank.

Advantageously the median plane of the bending face of the bending tool during this engagement with the shaping edge of shaping anvil faces the bearing plane for the binding comb blank under an obtuse angle, preferably closing in the direction of its associated working rotary movement, so that this leads to a simple arrangement of the bending tool on the tool carrier and favourable forces acting on the bending tool.

In a very simple manner, the bending face of the bending tool can be formed by a convexly rounded face or by a sliding edge which, despite simple construction of the bending tool, in the case of adequately limited surface roughness ensures a very gentle running on the surface of the binding comb blank, which is generally coated with varnish or the like. However, the bending face of the bending tool can also be formed by the circumferential surface of a bending rolling member, e.g. by the cylindrical circumferential surface of a bending roller or the like, so that the bending face, as a rolling face, does not slide on the binding comb blank during the bending process and instead rolls thereon, leading to a much gentler treatment of the binding comb blank surface. Particularly if the bending rolling member is mounted only at one end or is floating, it can be advantageous to support its circumferential surface on a correspondingly curved path on the side remote from the side intended for engagement with the shaping anvil or the binding comb blank and at least in the arc region in which the bending tool engages with said blank, so that the bending tool does not yield under the bending pressures which occur. Appropriately this path is formed by a freely rotating rotor, so that there is a purely rolling contact between the path and the bending tool and the bending rolling member is optionally brought into a rotary movement corresponding to its associated rolling movement prior to its engagement in the binding comb blank.

According to a particularly advantageous further development of the invention, the bending tool is adjustably and fixably mounted with respect to the tool carrier about a control axis approximately at right angles to the median plane of its bending face, so that the latter can always be precisely aligned with the shaping edge of the shaping anvil. This is possible in a simple manner if a longitudinally adjustable control ram accessible at one end is placed in a work spindle carrying the tool carrier, said ram being in articulated connection with the bending tool at a distance from the control axis.

The inventive construction also makes it advantageously possible for each bending stage or step, i.e. each shaping edge of the particular shaping anvil in the rotation direction of the tool carrier, to successively provide at least two similar or identical bending tools, which are preferably uniformly distributed about the rotation axis, so that e.g. for a full rotation of the tool carrier two bending processes can be performed, e.g. on adjacent longitudinal portions of the binding comb blank and this leads to a corresponding reduction of the impact speed of the bending tools on the binding comb blank, which leads to much gentler working thereof and also permits easy balancing of the tool rotor. Instead of this or in addition thereto, it is also possible to successively provide in the longitudinal direction of the binding comb blank at least two different bending tools of two bending stages, which are appropriately directly connected to one another with a smaller spacing than the longitudinal pitch of the binding comb blank, so that the latter is bent into its final shape intermittently and therefore carefully in two or more directly succeeding stages. Optionally instead of this, but in particular in addition thereto, it is advantageous to provide substantially identical tool carriers with bending tools on either side of the shaping blank provided on both longitudinal sides iwth shaping edges and in the same way as the bending tools successively arranged in the longitudinal direction of the bending comb blank they come into simultaneous bending engagement with said blank, so that in the vicinity of its two longitudinal sides the blank is profile-bent and e.g. is given a C-shaped profile in one operation. The bending tools successively arranged in the longitudinal direction of the bending comb blank can admittedly be arranged on separate tool carriers or work spindles, so that in each bending stage there is freedom concerning the choice of the position of the rotation axis, but a much greater simplification of the shaping device is obtained if said bending tools are provided in synchronously operating manner on the same tool carrier or work spindle.

So that prior to entry into the bending device and in particular the first bending device, the binding comb blank can be precisely aligned or oriented with respect thereto, it is advantageous to provide an alignment or orienting device for the lateral alignment or orientation of the binding comb blank adjacent to the start of the associated bending stage. Its alignment faces for the aligning engagement of the binding comb blank can also be provided in simple manner according to the invention on the associated tool carrier or work spindle, so that it is possible by different radial spacings to define said alignment face with respect to the rotation axis of those working phases in which the alignment device engages with the binding comb blank. For example, the alignment face could have a conical face widening in the feed direction giving a funnel-shaped tapered entry in the feed direction. However, it is particularly advantageous if the alignment device has at least one approximately part-cylindrical alignment face on the associated tool carrier for the associated longitudinal edge of the binding comb blank. The alignment face engages with the associated longitudinal edge of the binding comb blank at the latest from the start and/or at least up to the end of bending engagement of the at least one bending tool and secures the blank during this working phase against any lateral displacement. Thus, the alignment face can be kept in engagement with the binding comb blank over a relatively small working arc angle, particularly in such a way that during the advance of said blank it is out of engagement therewith. In order that at the start of each alignment cycle, the alignment face can again be carefully engaged with the binding comb blank, it is appropriate to follow its start by a rising entry or inlet face.

According to another feature of the invention, the particular tool carrier is mounted in a spindle head or headstock, which is adjustable at right angles to the median longitudinal plane of the binding comb blank via the bracket. In particular the tool carrier is adjustable in the direction counter to that at which the associated shaping edge of the shaping anvil is applied in spring loaded manner against an adjustable and fixable stop. On the one hand this makes it possible for the tools to escape from the working position when overloads occur and on the other hand the tools arranged on the associated work spindle can be jointly adjusted in said direction with respect to the fixed tools. according to an advantageous embodiment, for this purpose the headstock is mounted on the bracket about an oscillating or rocking axis at right angles to the engagement plane for the binding comb blank, spaced from the tool rotation axis and particularly below the same, so that there is no need for a carriage guide.

To give easier access to the fixed and/or moving tools for adjustment work or replacing tools, the tool carrier with its bearing or mounting can be moved into a disengaged position removed from the shaping anvil, which can e.g. be achieved in any random direction by a carriage guide. However, a particularly simple arrangement is obtained if the tool carrier with its mounting is pivotable about the rocking axis with a handle, so that only a single mounting is required for overload protection and for the transfer into the disengaged position. Handling can be simplified in that the two mountings of the tool carriers on either side of the shaping anvil are oppositely coupled by means of a lever joint or the like, so that by moving away a single headstock, the other is automatically transferred in gripper-like manner into the disengaged position.

The shaping device according to the invention can be retooled for the production of a virtually random number of different binding combs, if the particular tool carrier, optionally including its mounting or bearing or its headstock is interchangeably fixed as a set, preferably at least one bearing side part of the particular work spindle being detachably fixed to the headstock and/or the headstock as a whole is detachably fixed to the bracket, e.g. by drawing out the rocking axis. In the first case work spindles with different tool sets can be kept available, so that the shaping device can be retooled by changing the work spindles. In the second case it is possible to keep available complete headstocks with different tool sets for replacement purposes.

In order that the particular shaping anvil set can also be easily replaced for retooling purposes, in the longitudinal direction of the binding comb blank adjacent shaping anvils are fixed to a common intermediate support, such as a centering rail, which is in turn detachably fixed to the bracket. Thus, the shaping anvils can be prefitted to the intermediate support and kept available for replacement purposes, so that at the time of replacement it is merely necessary to detach or fix a prefitted subassembly.

In order to prevent a giving way or deflection of the binding comb blank adjacent to the shaping edge or between the shaping edges and at right angles to the bearing plane, i.e. so as to also prevent a lateral displacement of the binding comb blank during the bending process, it is usually appropriate to provide a holding down device which, at the latest as from the start of the bending process and appropriately up to the end thereof, presses or holds down the binding comb blank against a face e.g. provided on the shaping anvil and provided in the engagement plane for said blank. This holding down device can e.g. be constructed in rotary or revolving manner. In the first case the holding down device could be arranged in rotary manner about an axis roughly parallel to the longitudinal direction of the binding comb blank and be circumferentially provided with at least one holding down cam, which engages on the blank in the holding down position; it being possible to provide two or more, appropriately oppositely directed holding down devices. In the second case, for a gentler engagement in the binding comb blank, it is possible to provide a holding down device running belt-like manner with the blank advance and which is constantly engaged with the binding comb blank. As a result of the inventive construction, it is also particularly advantageously possible to arrange the holding down device in linearly reciprocating manner over a holding down stroke or travel, because the latter can be kept very small independently of the rotary movement of the bending tool and despite the common synchronous drive of said tool and the holding down device and is e.g. only slightly larger than the thickness of the binding comb blank. As a result of this limited stroke or travel, the mass forces which occur are also very small, so that no vibration problems occur. The holding down surface of the holding down device is appropriately toothed in accordance with the comb webs of the binding comb blank.

Accompanied by careful working of the binding comb blank, the shaping device according to the invention leads to very quiet running and only a limited amount of noise is produced. Particularly if the timing or cyclic advance of the binding comb blank takes place round three loops of siad blank, so that per bending proces in each case three loops of the blank are profile-bent, the inventive shaping device makes it possible to profile-bend far more loops per minute than in the case of the known devices. It has been found that it is readily possible to profile at least 3200 loops per minutes. The shaping device according to the invention is also easy to operate and only a few relatively inexpensive replacement parts are required for converting to different binding comb sizes, which greatly facilitates the size change. If the binding comb is formed by a wire comb, which is provided with wire webs reciprocating in meander-shaped manner between the longitudinal edges, then a wire bending device for producing the binding comb blank is appropriately positioned directly upstream of the shaping device and its outlet issues into the inlet of the shaping device. The binding comb blank can also be formed by a corresponding comb-like stamped or punched strip, so that a stamping or punching tool can then be positioned upstream for the binding comb blank.

These and further festures of preferred further developments of the invention can be gathered from the description and drawings and the individual features can be realised individually or in the form of subcombinations in any embodiment of the invention and in other fields.

BRIEF DESCRIPTION OF THE DRAWINGS

The invention is described in greater detail hereinafter relative to a non-limitative embodiment and with reference to the attached drawings, wherein show.

DETAILED DESCRIPTION OF THE INVENTION

Figure 1:
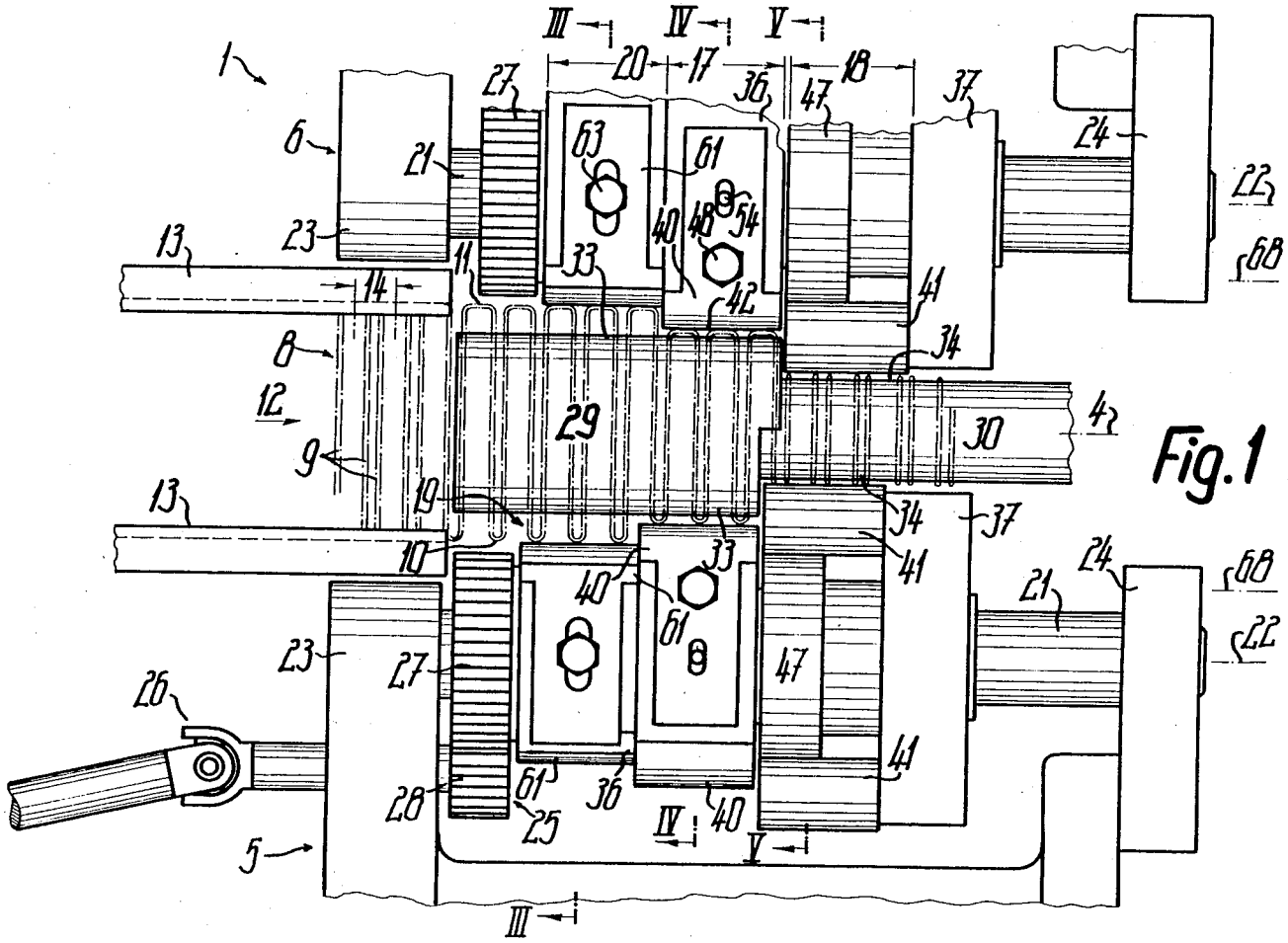
FIG. 1, a detail of a shaping device according to the invention in simplified plan view.
Figure 2:
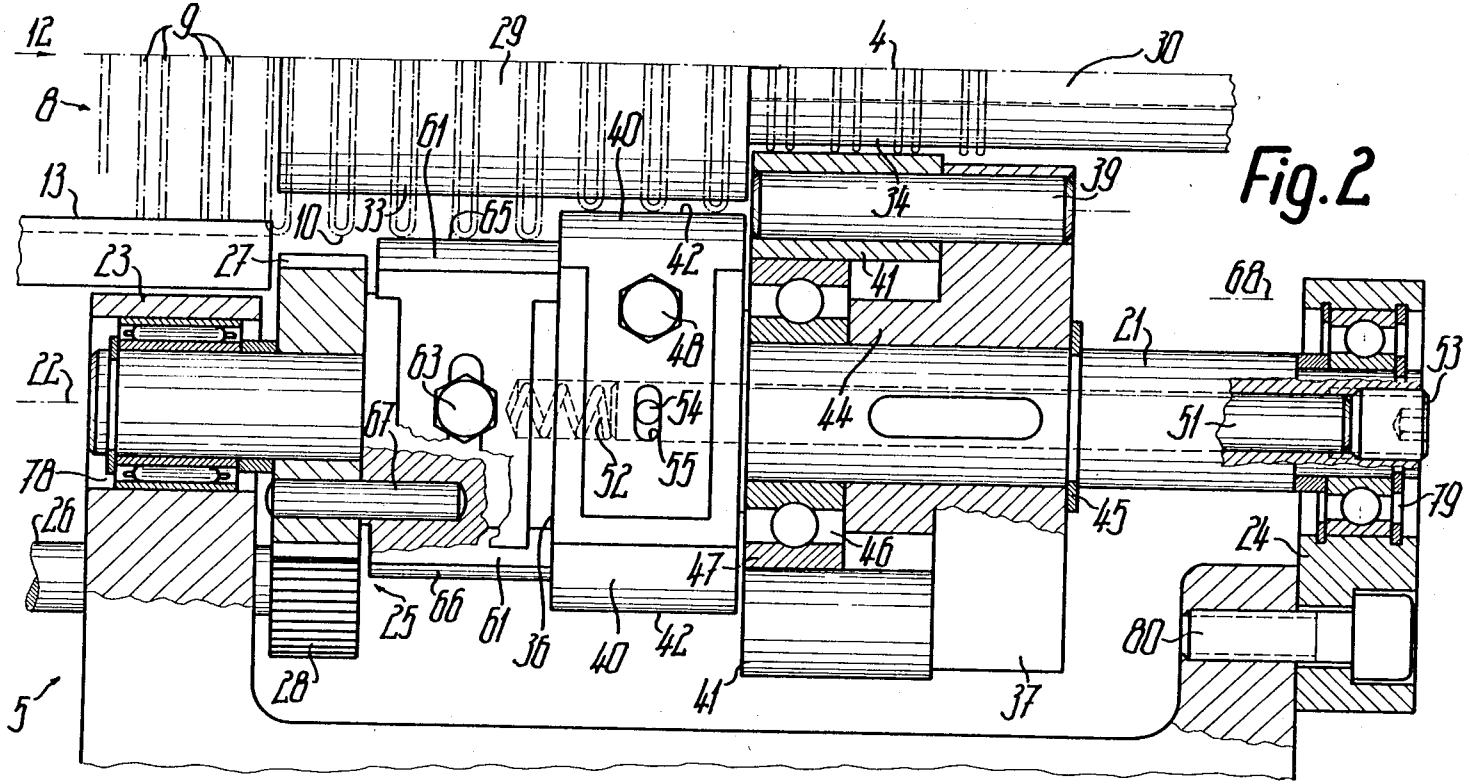
FIG. 2, a detail of the representation of FIG. 1 of a larger scale and in part sectional form.
Figure 3:
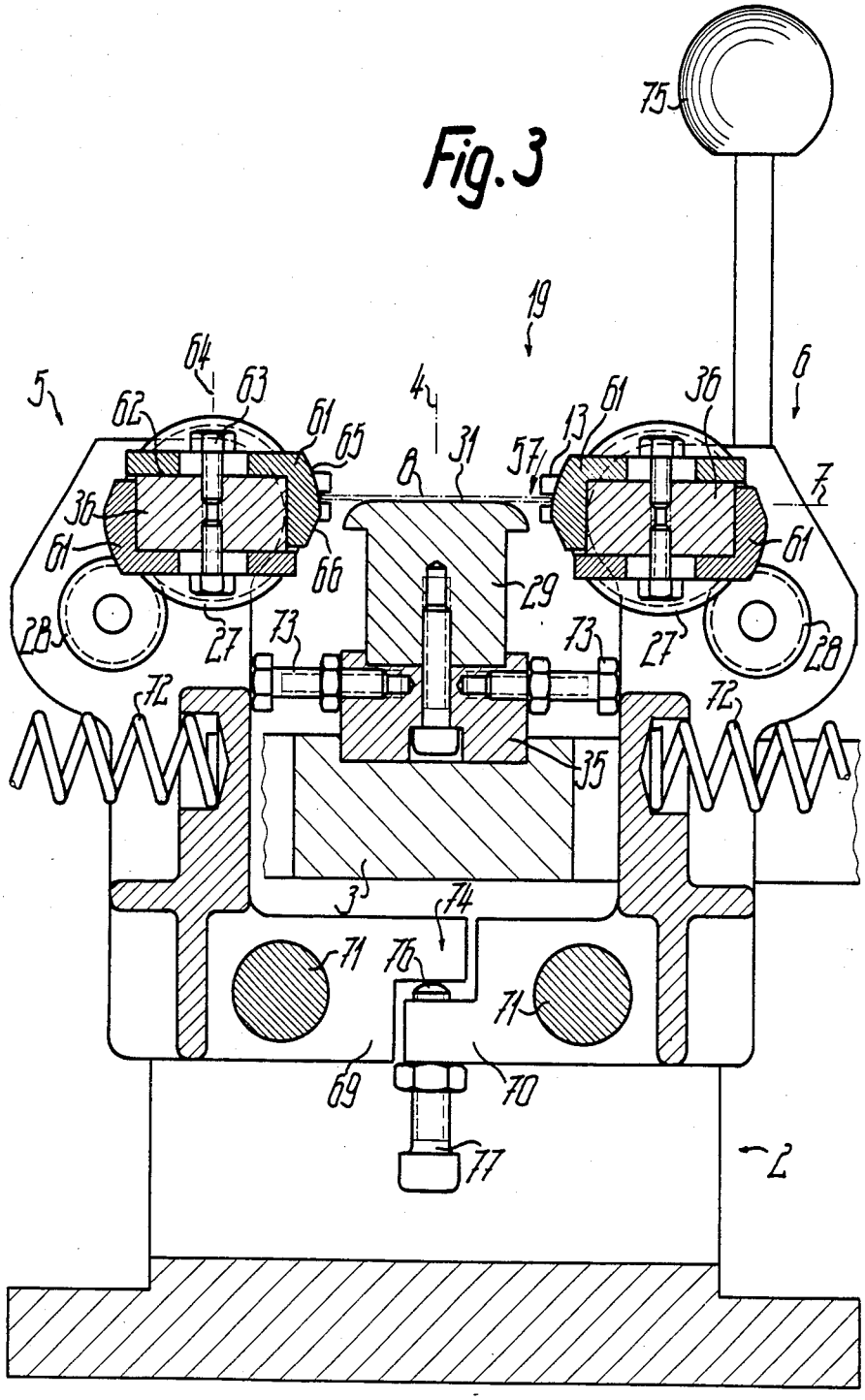
FIG. 3, a section along line III—III of FIG. 1.

As shown in FIGS. 1 to 8, a binding comb shaping device 1 according to the invention has on a bracket 2 provided as a machine bed a substantially horizontal machine table 3 and on either side of its median longitudinal plane 4 substantially mirror symmetrical headstock 5, 6. Shaping device 1 defines a horizontal engagement plane 7 for a binding comb blank 8 at right angles to the vertical median longitudinal plane 4 and which comprises a wire bent in meander-shaped manner, so that its comb webs 9 at right angles to plane 4 have the same length, i.e. extend in each case up to the two longitudinal edges 10, 11 of binding comb blank 8. Adjacent comb webs 9 have alternately larger and smaller spacing from one another, the two spacings are identical, so that the more closely adjacent comb webs 9 are rounded in semicircular manner on one longitudinal edge 10 and the more widely spaced comb webs 9 pass into one another via longitudinal webs on the other longitudinal edge 11. The binding comb blank 8 is fed to the shaping device 1 in the manner of a flat carpet in its longitudinal direction, namely parallel to the engagement or bearing plane 7 and the median longitudinal plane 4 in a feed direction indicated by arrow 12. For this purpose, guide rails 13 are provided on either side of plane 4 and the longitudinal sides of the binding comb blank 8 slide in longitudinal grooves thereof roughly level with the bearing plane 7. For driving the binding comb blank 8 in the feed direction indicated by arrow 12, immediately upstream of the shaping device 1, e.g. in the vicinity of guide rails 13, is provided a feed or advance finger (not shown) or the like, which grips the binding comb blank 8 and advances it by three loops 14 in the working stroke of the shaping device 1.

For each longitudinal side of the binding comb blank 8, shaping device 1 has two successively arranges bending devices 15, 16 in the advance direction indicated by arrow 12 and in each case two similar bending devices 15, 16 facing one another on either side of the median longitudinal plane 4 are displaced with respect to one another in the direction of arrow 12 by half a loop 14 of the binding comb blank 8 and form 1 of two bending stages 17, 18. In the first bending stage 17 in the direction of arrow 12, the binding comb blank 8 is bent forward in flat U-shaped manner according to FIGS. 4 and 7 and in the final bending stage 18 the bending comb blank 8 is bent to its final C-shape according to FIGS. 5 and 8, in which in longitudinal view it has two approximately semicircular leg portions facing one another with their concave insides and an e.g. planar portion connection the same. Immediately upstream of the first bending stage 17 is provided an alignment device 19, which aligns the binding comb blank 8 at right angles to the median longitudinal plane 4 in approximately clearance-free manner in the vicinity of an alignment stage 20 in series with the bending stages 17, 18.

For the reception of the movable tools of the bending devices 15, 16 and the alignment device 19, a work spindle 21 is mounted in rotary manner about a rotation axis 22 parallel to bearing plane and median longitudinal plane 4 in each headstock 5 and 6. For this purpose, each headstock 5 or 6 is U-shaped in plan view and has two legs directed towards the median longitudinal plane 4, so that one leg forms a bearing side part 23 located at guide rails 13 for one end of the associated work spindle 21 and the other legs forms a support leg for the detachable fixing of a bearing side part 24 for the other end of work spindle 21. Between the two bearing side parts 23, 24 are provided the associated tools on the work spindle 21. Adjacent to the inside of the bearing side part 23, each work spindle 21 is drive-connected to driving member 26 by means of a gear stage 25. For this purpose, adjacent to the inside of bearing side part 23 a gear wheel 27 is provided on each work spindle 21. Said gear wheel meshes with a downwardly and outwardly displaced pinion 28, which is also mounted in bearing side part 23 and connected with the driving member 26 constructed as a drive shaft. Driving member 26 is driven synchronously and in particular in alternating stroke with the advance for the binding comb blank 8.

Each bending device 16 or 16 has a shaping anvil 29 or 30 fixed to the machine table 3 and, in accordance with the shape of the binding comb blank 8 to be bent, is symmetrical to the median longitudinal plane 4 and its at least partly planar top surface is located in bearing plane 7. This planar, upper bearing surface 31 or 32 passes in the case of shaping anvil 29 of the first bending stage 17 and at both longitudinal sides into approximately quandrant-shaped, downwardly convexly curved shaping edges 33 and in the case of the shaping anvil 30 of the second bending stage 18 into semicircular shaping edges 35 with roughly the same radius of curvature, the spacing of the particular curvature axis of shaping edge 34 from the median longitudinal plane 4 is smaller roughly by the radius of curvature than the corresponding spacing of the curvature axis of shaping edge 33. The shaping edges 33, 34 on both longitudinal sides of the two shaping anvils 29, 30 are displaced with respect to one another by a half loop 14 of the binding comb blank 8 in the advance direction indicated by arrow 12 and corresponding to the facing bending devices, so that the two shaping anvils 29, 30 engage in one another via a step on their facing ends. Both anvils 29, 30 are detachably premounted with screws or the like on an intermediate support 35 in the form of a centering rail extending in the direction of arrow 12 parallel to machine table 3 and with said intermediate support 35 are jointly fixed to machine table 3. Shaping anvils 29, 30 engage in centered manner in a slot on the top of intermedate support 35, which in turn engages in centered manner in a corresponding slot on the top of machine table 3, so that anvils 29, 30, as a building set together with the intermediate support 35 are fixed in precisely aligned manner on machine table 3 or are removed therefrom. As a result of the described construction, to facing bending devices 15, 16 are associated with each shaping anvil 29 or 30.

Figure 4:
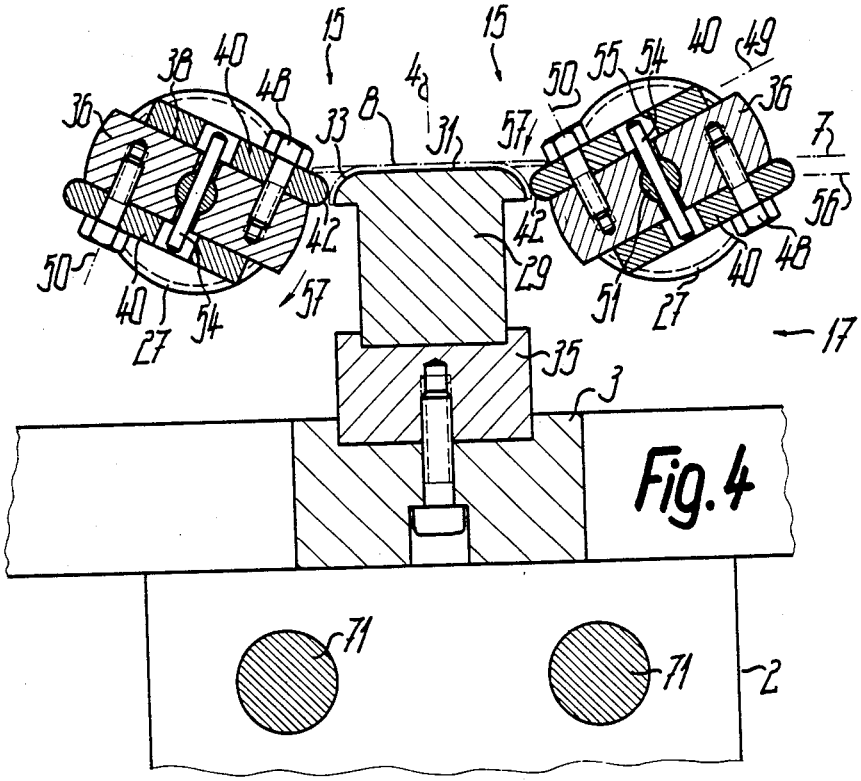
FIG. 4, a simplified section aling line IV—IV of FIG. 1.
Figure 5:
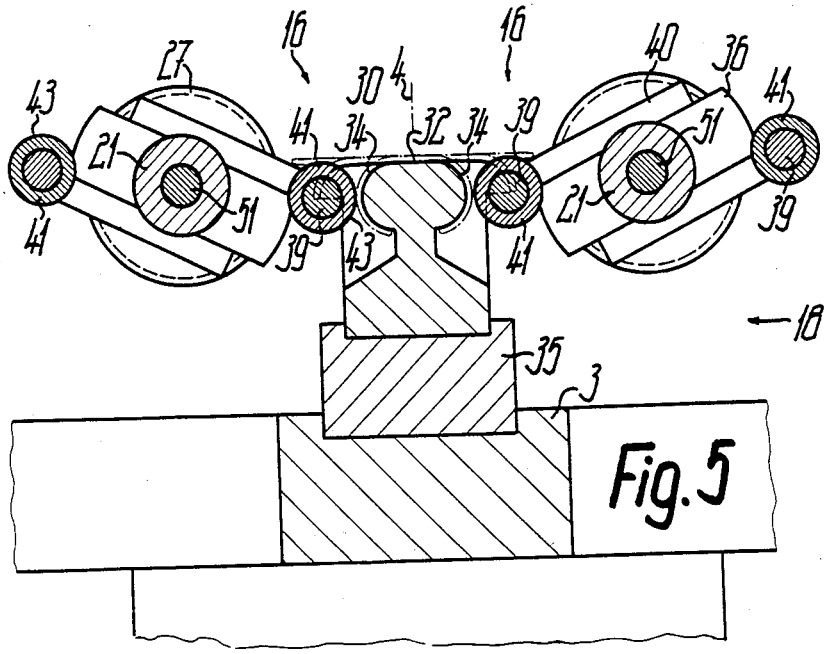
FIG. 5, a simplified section along line V—V of FIG. 1.
Figure 6:
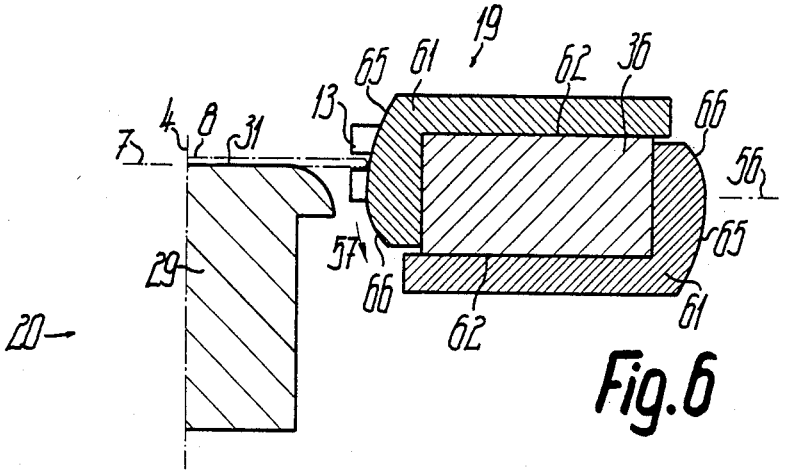
FIGS. 6 to 8, details of FIGS. 3 to 5 in simplified, larger scale representation.

Each bending device 15, 16 has a tool carrier 36 or 37 arranged on the associated work spindle 21 and which, as shown in FIG. 4, for all the bending devices is constructed in one piece with the particular associated work spindle 21 or, as shown in FIG. 5, can be formed by a separate tool carrier 37, which is detachably arranged on the associated work spindle 21 and can e.g. be removed and twist-secured in the longitudinal direction. One tool carrier and in particular carrier 36 of the first bending stage 17 can be constructed in one piece with the associated work spindle 21 and the other tool carrier 37 can be formed by a separate body. Each tool carrier 36 or 37 of at least one bending device 15 and particularly bending device 15 of the first bending stage 17, has two symmetrical fixing faces 38 for in each case on bending tool 40 on either side of an axial plane of the associated rotation axis 22. The bending tools 40 of bending devices 15 are formed by planar plates, which are approximately T-shaped in elevation and which on the free longitudinal edge of the T-head web are rounded in cross-section in semicircular manner and form with said longitudinal edge an approximately linear, narrow bending face 42. These bending faces 42 project radially by a small amount over the associated tool carrier 36, so that the bending tools 40 are supported over a large area, in a stable manner on tool carriers 36. Tool carrier 37 of the other bending device 16, adjacent thereto in the feed direction indicated by arrow 12, is faced from the associated tool carrier 36 by roughly the length of its bending tools 41 and carries bearing pins 39 parallel to the particular associated axis and projecting freely to the adjacent bending device 15 and on which cylindrical rollers are mounted in rotary manner as bending tools 41 and their circumferential surfaces in each case form a bending face 43. The bending tools 41 are also uniformly distributed around the associated rotation axis 22, i.e. in the represented embodiment are reciprocally displaced by 180°. Tool carrier 37, which like the tool carrier 36 can be formed by a cylindrical body flattened on both sides, is arranged detachably and in twist-secured manner on the associated work spindle 21, e.g. in that it is mounted with a hub 44 on work spindle 21, is prevented from twisting with respect thereto by an adjusting spring or the like and is axially secured by a circlip 45 or similar fixing means detachably engaging in a groove of work spindle 21. Between the hub 44 of tool carrier 37 and the associated adjacent tool carrier 36 an antifriction bearing 46 is provided on work sprindle 21 and its outer ring forms a rotor 47, on which are supported the circumferential surfaces of the bending tools 41 with their regions facing rotation axis 22 and up to the free ends thereof. For ease of viewing reasons, the antifriction bearing 46 is not shown in FIG. 5.

Bending tools 40 are locked against the associated fixing face 38 by a screw 48 at right angles to the median plane 49 thereof or the associated fixing face 38. Between the associated rotation axis 22 and the bending face 42 of the associated bending tool 40, each screw passes through the latter in a bearing opening and is located in a plane at right angles to median longitudinally plane 4, which is provided roughly in the centre of the length of the associated bending face 42. Thus, each screw 48 forms a swivel bearing pin or bolt for the mounting of bending tool 40 pivotable about said median bolt axis with respect to the associated tool carrier 36. A control mechanism operable from one end of the associated work spindle 21 and namely from the end remote from drive member 26 serves to pivot bending tool 40 about said control axis 50. This control mechanism has a control ram 51 located in rotation axis 22 and displaceably mounted in a blind bore of work spindle 21 and the inner end of the ram is supported by means of an axial compression spring 52 with respect to the work spindle 21 or the bottom of the longitudinal bore. The outer end of the cylindrical control ram 51 engages on the inner end face of a set screw 53 mounted in the associated end of work spindle 21 and which can be turned by a suitable ram and is mounted with its external thread in an internal thread of the longitudinal bore of work spindle 21. Adjacent to its inner end, the control ram 51 has a transverse pin 54, whose two ends movably pass through the associated tool carrier 36 in the longitudinal direction of work spindle 21 and engages in articulation or joint openings 5 of both associated bending tools 40. The joint opening 55 of each bending tool 40 is formed by a slot extending at a right angle to the associated bending face and in which engages in substantially clearance-free manner in the longitudinal direction of control ram 51 like an articulation or joint cam, the associated transverse pin 54. Longitudinal adjustments of the control ram 51 lead to pivoting movements of the two associated bending tools 40 about thier control axis 50, so that in this way the parallelism of their bending faces 42 can be precisely adjusted with respect to the mediam longitudinal plane 4. After adjustment, the bending tools 40 are appropriately fixed against tool carrier 36 by tightening screws 48.

The two rotation axes 22 of the two work spindles 21 are located in a common axial plane 56 parallel to bearing plane 7 and which is set back by roughly half the radius of curvature of the shaping edges 33, 34 compared with bearing plane 7 and is moved downwards in the case of bearing faces 31, 32 at the top. The flight circles of the bending faces 42, 43 of bending tools 40, 41 are made so large, that they have a minimum spacing with respect to the associated shaping edge 33 or 34 and this is only slightly larger or roughly the same as the thickness of the binding comb blank 8. the working rotation direction indicated by arrow 57 of the oppositely directed work spindles 21 is chosen in such a way that the bending faces 42, 43 of the bending tools in the phase of the bending working movement approach the binding comb blank 8 from the side opposite to bearing face 31 or 32 and on moving past the associated shaping edge 33 or 34 bend it against them. In the first bending stage 17 on each longitudinal side of the binding comb blank 8 an approximately quandrant-shaped profile bending extending up to the associated longitudinal edge 10 or 11 is produced, after which the thus present blank 8 is advanced onto the narrower shaping anvil 30, which produces a further, roughly quandrant-shaped profile bend towards median longitudinal plane 4 on the particular present portion, so that on the associated side of the bending comb blank 8 an approximately semicircular profile is obtained. The length of each bending tool corresponds to three loops 14 of the binding comb blank and consequently the feed or advance length during a feed or advance stage. The completely profile-bent binding comb moves away from the shaping device 1 over the end of shaping anvil 30. Roughly in the centre of the bending phase, the curvature axis of the particular gending face 42 or 43 is roughly in the axial plane 56.

Figure 7:
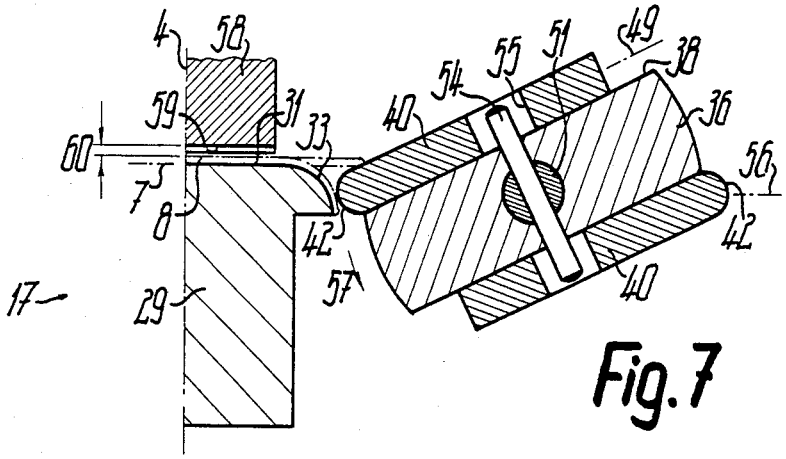
Figure 8:
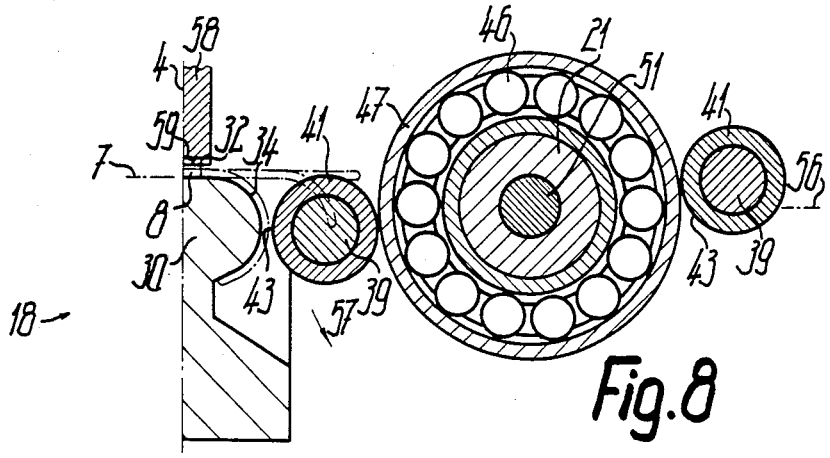

As shown in FIGS. 7 and 8, a holding down device 58 for the binding comb blank 8 is provided facing the bearing faces 31, 32 of shaping anvils 29, 30 and its holding down surface, which is toothed in accordance with the comb webs 9 and parallel to the bearing plane 7, in the vicinity of each shaping anvil 29 or 30 is at the most as wide as the bearing face 31 or 32 thereof and whose holding down stroke or travel 60 is only slightly larger than the thickness of blank 8. During the bending process, by pressing the binding comb blank 8 against bearing face 31 or 32, the holding down device 58 fixes the same with respect to the associated shaping anvil 29 or 30 both transversely and longitudinally. During the advance of the binding comb blank 8, the holding down device 58 is in its retracted release position. Holding down device 58 is driven in linear reciprocating manner at right angles to the bearing plane 7.

As is particularly shown in FIGS. 1 to 3 and 6, the alignment device 19 is provided on each work spindle 21 or on an e.g. removable work carrier arranged thereon with two alignment tools 61 uniformly distributed about the associated rotation axis 22. The tool carrier for these alignment tools 61 can in each case be formed by the tool carrier 36 of the adjacent bending device 15, which is cross-sectionally rectangular in this region. Each alignment tool 61 is cross-sectionally angular through rotation axis 22, one leg being locked by a screw 63 against a fixing face 62 of tool carrier 36 in such a way that the alignment tool 61 is adjusted at right angles to rotation axis 22 and about a control axis 36 intersecting the same at right angles and the fixing surface 62 with respect to the associated tool carrier 36, and can be secured in the particular set position. The other leg of each alignment tool 61 engaging around the tool carrier 36 is provided on its longitudinal side facing the median longitudinal plane 40 in the corresponding rotation phase, an alignment face 65 part cylindrically curved about its rotation direction and which extends over an acute angle are of e.g. less than 45° and which represents the radial face of each alignment tool 61 furthest from the associated rotation axis 22. In the working rotation direction indicated by arrow 57 in front of each alignment face 65 is provided an entry face 66 connected onto the same and which rises from limited radial spacing with respect to the associated rotation axis 22 against the working rotation direction 57 to the radial spacing of the associated alignment face 65 and passes into the latter. The entry face 66 can, according to FIG. 3, be a planar face, or according to FIG. 6 a spiral, convexly rising face, so that a very gentle constant transition into alignment face 65 is obtained. The rotation alignment of the alignment tools 61 with respect to the bending tools is such that after passing the entry faces 66, alignment faces 65 have just engaged the longitudinal edges 10, 11 of the binding comb blank 8 when the holding down device 58 fixes said blank or when the bending tools 40, 41 engage with said blank. During the advance of the binding comb blank 8, alignment faces 65 are disengaged. In a view on their fixed legs, the alignment tools 61 are T-shaped in much the same way as bending tools 40 and have the alignment face 65 on the T-head web. In the advance direction of arrow 12, the alignment tools 61 are connected directly onto the adjacent bending tool 40, it being possible to provide only a small spacing necessary for the adjustment of the bending tools 40. The length of the alignment faces 65 is roughly the same as that of the bending faces 42, 43 of bending tools 40, 41. Alignment tools 61 are immediately adjacent to the associated gear wheel 27, which engages in the associated smaller pinion 28 under a reduction ration of two 2:1 and by means of a coupling member 67, e.g. a coupling bolt, is detachably drive-connected in non-rotary manner to the associated tool carrier 36.

Each headstock 5 or 6 on the side of machine table 3 remote from the bearing face 31 or 32 of shaping anvil 29, 30, i.e. below its underside, is mounted in the manner of an upright, one-armed lever pivotable about a rocking axis 68 on bracket 2, axis 68 being displaced towards the median longitudinal plane 4 with respect to the associated rotation axis 22 and appropriately is in an axial plane roughly at right angles to the bearing plane 7 and whose spacing from the associated rotation axis 22 is roughly half the average flight circle diameter of the bending tools 40, 41. In the case of pivoting movements about rocking axis 68 within the pivot angle required for the fine adjustment of the bending and alignment tools at right angles to the median longitudinal plane 4, said tools perform negligibly small relative movements at right angles to bearing plane 7. For mounting purposes, below the machine table 3, the headstocks 5, 6 have inwardly directed leg levers 69, 70, which are traversed by bearing rods 71, whose ends preferable engage in detachable manner in bracket 2 or headstocks 5, 6, so that each headstock 5 or 6 can be removed as a whole from bracket 2. Each headstock is loaded by a spring 72 e.g. in the form of a helical compression spring in the working direction counter to the median longitudinal plane 4 and said spring acts on headstock 5 or 6 between rotation axis 22 and the rocking axis 68 parallel thereto. Each headstock 5 or 6 is secured in the working position by a stop 72 adjustable and fixable at right angles to the median longitudinal plane 4 and which is e.g. formed by a set screw and is preferably arranged on intermediate support 35, so that each interchangeable shaping anvil set carries its associated, already preadjusted stops 73.

The two levers 69, 70 of headstock 5, 6 are oppositely coupled to one another by means of a lever joint 74. Headstock 6 has a handle 75 in the form of a gripping rod which projects above its top surface and which enables it to be pivoted into a disengaged position counter to the tension of spring 72 and away from median longitudinal plane 4 about rocking axis 68. Headstock 6 is provided on its lever 70 with a drive 76 engaging positively on lever 69 of the other headstock 5 in the disengagement movement direction and which has a curved driving face rolling and slidably engaging on the opposite face of lever 69 and through which the joint axis of lever joint 74 is defined. Driver 76 is formed by the convexly curved end of a coupling screw 77, which is arranged in adjustable and fixable manner on lever 70, whose median axis in the working position is roughly at right angles to the bearing plane 7 in median longitudinal plane 4 and which is accessible from the bottom of levers 69, 70. If headstock 6 with handle 75 is swung outwards into its disengaged position, it automatically takes with it headstock 5 by means of lever joint 74. Thus, both the fixed and rotary tools and tool sets are very easily accessible.

Each work spindle 21 is mounted at its two ends with bearings or mountings 78, 79, e.g. in the form of antifriction bearings on the associated headstock 5 or 6. With or from said bearings 7, 79, work spindle 21 can be detachably arranged with respect to the particular headstock 5, 6, so that it can be replaced, together with all the tools thereon. The particular bearing side part 24 is detachably fixed with screws 80 to headstock 5 or 6, so that following the removal of the bearing side part 24, the other end of work spindle 21 can be drawn out of headstock 5 and replaced with the bearing side part 24 as a construction set.

Binding combs of the type produced and shaped by the device of the invention are useful for binding of sheet layers as paper blocks or stacks by bending the C- or rounded E-shaped combs, such that their smaller bends 10 are inserted into binding holes provided along one edge of the stack.

What is claimed is:

1. A binding comb shaping device (1) for manufacturing binding combs from binding comb blanks (8) for comb binding of sheet layers, each of said binding comb blanks (8) having longitudinal boundaries, comb webs (9) arranged transversely between said longitudinal boundaries in a comb partition unit (14) and said binding combs having a bent profile in a view parallel to a longitudinal direction thereof, said shaping device (1) comprising:

a base means (2) supporting operational parts of the shaping device;

at least one bending stage (17, 18) having at least one bending device (15, 16) supported by said base means (2), said bending device (15, 16) having a shaping anvil (29, 30) defining a plane (7) of engagement for engaging the binding comb blank (8), said shaping anvil (29, 30) further defining a median longitudinal plane (4) oriented substantially at right anglges to said plane (7) of engagement, said shaping anvil (29, 30) having at least one shaping edge (33, 34);

at least one bending tool (40, 41) having a bending face (42, 43) provided for a bending engagement with the shaping edge (33, 34);

means for rotatably driving said bending tool (40, 41) in an operation movement around a tool axis (22) with respect to and towards said shaping edge (33, 34) while having the bending comb blank (8) interposed between said shaping edge (33, 34) and said bending edge (42, 43);

at least one tool porter (36, 37) for bearing a respective bending tool (40, 41), said tool porter (36, 37) being displaceable with respect to said base means (2) by a displacement bearing;

at least one headstock (5, 6) rotatably mounting a respective tool porter (36, 37) in a porter bearing for holding the tool axis (22) in a bending operation position, wherein the at least one headstock (5, 6) is displaceably mounted with respect to said base means (2) in a direction transverse to said median longitudinal plane (4).

2. A shaping device according to claim 1, wherein the at least one headstock (5, 6) is spring-loaded in a direction towards the shaping edge (33, 34) of the shaping anvil (29, 30), and further comprising an adjustable stop operable to limit movement of the headstock (5, 6) towards the shaping edge (33, 34).

3. A shaping device according to claim 1, wherein the at least one headstock (5, 6) is pivotably mounted on the base means (2) about a rocking axis (68), said rocking axis (68) being located at a distance from the tool axis (22) in a direction at right angles to the plane (7) of engagement for engaging the binding comb blank (8).

4. A shaping device according to claim 3, wherein said rocking axis (68) is located substantially parallel to the tool axis (22), said tool axis (22) being located substantially parallel to said plane of engagement (7) and to said median longitudinal plane (4).

5. A shaping device according to claim 30, wherein said tool axis (22) is located laterally adjacent to said shaping edge (33, 34) of said shaping anvil (29, 30).

6. A shaping device according to claim 1, wherein at least two similar bending tools (40, 41) are arranged behind one another with respect to a direction of displacmeent of the tool porter (36, 37).

7. A shaping device according to claim 6, wherein the bending tools (40, 41) are uniformly distributed about the tool axis (22), said bending tools (40, 41) being associated with a same bending stage (17, 18).

8. A shaping device according to claim 1, wherein at least two different bending tools (40, 41) of two bending stages (17, 18) are provided on a common tool sprindle (21), said bending tools (40, 41) being located behind one another in the longitudinal direction of the binding comb blank (8).

9. A shaping device according to claim 1, wherein two opposite longitudinal sides of the shaping anvil (29, 30) are provided with shaping edges, two opposite tool porters (36, 37) being provided for said shaping edges (33, 34) said tool porters (36, 37) being substantially identical and both having bending tools (40, 41).

10. A shaping device according to claim 1, wherein at least one tool porter (36, 37) and the associated headstocks (5, 6) is movable into a position of disengagement with respect to the associated shaping anvil (29, 30).

11. A shaping device according to claim 10, wherein the tool porter (36, 37) is pivotable about the rocking axis (68) by means of a handle (75).

12. A shaping device according to claim 1, further comprising means coupling two headstocks (5, 6) of two tool porters (36, 37) on two sides of the shaping anvil (29, 30) said means coupling the two headstock (5, 6) providing a reciprocal movement of the headstock (5, 6).

13. A shaping device according to claim 12, wherein said means is a lever joint.

14. A shaping device according to claim 1, wherein at least one of the tool porters (36, 37) is replaceably arranged as a set.

15. A shaping device according to claim 1, wherein the particular tool porter (36, 37) is replaceably arranged inclusive with the porter bearing associated therewith.

16. A shaping device according to claim 1, wherein the particular headstock (5, 6) forms a set with the associated tool porter (36, 37), said set being replaceably arranged.

17. A shaping device according to claim 1, wherein at least one headstock (5, 6) has a bearing side part (24) for rotatably receiving an associated tool spindle (21), said bearing side part (24) being detachably fixed to said head stock (5, 6).

18. A shaping device according to claim 1, wherein the particular headstock (5, 6) is detachably fixed to the base means (2) as an entity.

19. A shaping device according to claim 1, wherein the bending face (42, 43) of at least one bending tool (40, 41) is linear, said bending face (42, 43) extending over a plurality of comb partition units (14) of the binding comb blank (8), thereby commonly engaging a plurality of partition units (14) of the binding comb blank (8) in the associated bending stage (17, 18) during each revolution.

20. A shaping device according to claim 1, wherein means are provided for stepwise operating the bending tool (40, 41) together with a feed means provided for advancing the binding comb blank (8) in a feed direction (12) parallel to the longitudinal direction.

21. A shaping device according to claim 20, wherein the feed means is arranged upstream of the bending tool (40, 41) with respect to the feed direction (12).

22. A shaping device according to claim 1, wherein a median plane (49) of the bending face (42) of the bending tool (40) is positioned at an obtuse angle with respect to the plane (7) of engagement for the binding comb blank (8) during the engagement of said bending face (42) with the shaping edge (33) of the shaping anvil (29), said angle converging in the direction of the rotary operation movement of said bending face (42).

23. A shaping device according to claim 1, wherein the bending face (42, 43) of at least one bending tool (40, 41) is a convexly rounded face.

24. A shaping device according to claim 1, wherein the bending face (42) of at least one bending tool (40) is a tool sliding edge substantially semicircular in cross-section.

25. A shaping device according to claim 1, wherein the bending face (43) of at least one bending tool (41) is formed by a circumferential surface of a bending rolling member supported on a rotor (47) on a side remote from the shaping edge (34) of the shaping anvil (30).

26. Shaping device according to claim 1, wherein adjacent to the bending stage (17, 18) formed by at least one bending tool (40, 41) is provided an alignment device (19) for laterally aligning the binding comb blank (8) with respect to the associated shaping anvil (29, 30).

27. A shaping device according to claim 26, wherein the alignment device (19) has at least one substantially partial cylindrical alignment face (65) for the associated longitudinal boundary of the binding comb blank (8), said alignment face (65) being provided on the associated tool porter (36), an ascending catch face (66) joining in front of the alignment face (65) with respect to the rotatioal operation movement.

28. A shaping device according to claim 26, wherein the bending face (42, 43) of at least one bending tool (40, 41) is in bending engagement with said bending comb blank (8) from a beginning to an end of said bending engagement, means being provided for holding said alignment device (19) in aligning engagement with the associated longitudinal boundary of the binding comb blank (8) during the bending engagement.

29. A shaping device according to claim 1, wherein the shaping edge (33, 34) of the shaping anvil (29, 30) has an extension at right angles to said plane (7) of engagement and a center of said extension, the tool axis (22) of at least one bending tool (40, 41) when positioned in the bending operation position, being located substantially in a center of said extension of the associated shaping edge (33, 34) of the shaping anvil (29, 30), said shaping edge (33, 34) being substantially quandrant-shaped.

30. A shaping device according to claim 1, further comprising means for adjusting at least one bending tool (40) with respect to the tool porter (36) about a control axis (50), said control axis (50) being located substantially at right angles with respect to the median plane (49) of the associated bending face (42).

31. A shaping device according to claim 30, wherein in the tool spindle (21) supporting the tool porter (36) is provided a control ram (51) having an end accessible for operation, said control ram (51) being longitudinally adjustable and engaging the bending tool (40) at a distance from the control axis (50) in an articulated manner.

32. A shaping device according to claim 1, wherein shaping anvils (29, 30) located adjacent to one another with respect to the longitudinal direction of the binding comb blank (8) are fixed to a common intermediate support (35), said intermediate support (35) being detachably fixed to the base means (2) and positioned by centreing means.

33. A shaping device according to claim 1, further comprising a holder (58) for securing the binding comb blank (8) with respect to the shaping anvil (30), and means for driving said holder (58) over a holder stroke (60), said holder (58) facing the shaping anvil (30).

34. A shaping device according to claim 33, wherein a stroke length of said holder stroke (60) is substantially equal to a thickness of the binding comb blank (8).

* * * * *

UNITED STATES PATENT AND TRADEMARK OFFICE

CERTIFICATE OF CORRECTION

PATENT NO. : 4,721,136

DATED : January 26, 1988

INVENTOR(S) : Guido Negro

It is certified that error appears in the above-identified patent and that said Letters Patent is hereby corrected as shown below:

Column 16, line 11, delete "centreing" and insert --centering-- therefor.

Signed and Sealed this

Twenty-eighth Day of March, 1989

*Attest:*

DONALD J. QUIGG

*Attesting Officer*

*Commissioner of Patents and Trademarks*